United States Patent [19]

Lang

[11] 4,377,994

[45] Mar. 29, 1983

[54] RPM GOVERNOR FOR FUEL-INJECTED INTERVAL COMBUSTION ENGINES, ESPECIALLY A CENTRIFUGAL GOVERNOR OF AN INJECTION PUMP FOR DIESEL MOTOR VEHICLE ENGINES

[75] Inventor: Thomas Lang, Benningen, Fed. Rep. of Germany

[73] Assignee: Robert Bosch GmbH, Stuttgart, Fed. Rep. of Germany

[21] Appl. No.: 389,342

[22] Filed: Jun. 17, 1982

Related U.S. Application Data

[63] Continuation of Ser. No. 114,155, Jan. 22, 1980, abandoned.

[30] Foreign Application Priority Data

Jan. 25, 1979 [DE] Fed. Rep. of Germany ..... 2902731

[51] Int. Cl.[3] ..... F02D 1/04

[52] U.S. Cl. ..... 123/339; 123/357; 123/368

[58] Field of Search ..... 123/339, 357, 358, 366, 123/368, 373, 374

[56] References Cited

U.S. PATENT DOCUMENTS

| | | | |
|---|---|---|---|
| 4,099,506 | 7/1978 | Kolb | 123/339 |
| 4,143,634 | 3/1979 | Ritter et al. | 123/339 X |
| 4,191,051 | 3/1980 | Kawata et al. | 123/339 X |
| 4,205,639 | 6/1980 | Kawase et al. | 123/339 X |
| 4,286,558 | 9/1981 | Djordjevic et al. | 123/373 X |

*Primary Examiner*—Tony M. Argenbright
*Attorney, Agent, or Firm*—Edwin E. Greigg

[57] ABSTRACT

An rpm governor for fuel-injected internal combustion engines is proposed, in particular a centrifugal rpm governor of an injection pump for Diesel motor vehicles, in which the idling rpm is also held constant when the engine is cold or loaded by additional consumers, in order to assure smooth running of the engine and the most favorable values for fuel consumption and exhaust emissions. The governor contains an idling correction apparatus with an electromagnet, which transmits an additional adjustment force, which is preferably independent of travel distance and variable only by the energizing current of a control circuit, onto the governor member via a transmission element. By means of varying or switching on or off of the adjustment force, the idling rpm which is fixed by the initial stress of an idling spring for the warm and unloaded engine is also held constant under changing operational conditions.

14 Claims, 2 Drawing Figures

RPM GOVERNOR FOR FUEL-INJECTED INTERVAL COMBUSTION ENGINES, ESPECIALLY A CENTRIFUGAL GOVERNOR OF AN INJECTION PUMP FOR DIESEL MOTOR VEHICLE ENGINES

This is a continuation, of application Ser. No. 114,155 filed Jan. 22, 1980, now abandoned.

BACKGROUND OF THE INVENTION

The invention relates to an rpm governor for fuel-injected internal combustion engines, in particular a centrifugal governor of an injection pump for Diesel motor vehicle engines.

A centrifugal governor of this kind is already known (German Offenlegungsschrift No. 2 644 994) now U.S. Pat. No. 4,143,634, in which the initial stress of the idling spring is increased when the engine is cold by means of an idling correction apparatus equipped with a thermostat, in order to assure smooth running of the engine. The corrective final control element embodied as a thermostat is heated by a suitable apparatus attached to the electrical control circuit, and the duration of its switched-on time, which is necessary only during the warm-up phase of the engine, is limited by means of a temperature-dependent resistor introduced into the electrical circuit of the heating apparatus, this resistor preferably being embodied as a cold conductor (PTC resistor). This apparatus has the disadvantage that substantial forces must be brought to bear on a part of the thermostat because the idling spring, in order to fix the idling rpm, is already in contact, with a certain initial stress, with an adjustable support element. Furthermore, rapid adjustment of the idling rpm to changed engine loads is not possible in such an apparatus, because it functions relatively slowly and sluggishly.

OBJECT AND SUMMARY OF THE INVENTION

The rpm governor in accordance with the invention has the advantage over the prior art in that the adjustment force of the corrective final control element, which is dependent on at least one engine parameter, can be exerted at a point which is arbitrary and also favorable from the standpoint of available structural space on one of the movable elements of the governor or the injection pump used for controlling the idling position of the supply quantity adjustment member; thus there is great freedom as to the disposition of the idling correction apparatus. The adjustment force of the corrective final control element is superimposed on the governor forces and functions most favorably in the direction of the idling spring, counter to the adjustment force of the governor element; however, it is also possible for it to operate in the opposite direction. The associated control circuit may be embodied in simple fashion for open-loop control of the corrective final control element in the sense of maintaining the idling rpm or for closed-loop control of a constant idling rpm, and the adjustment force brought to bear by the corrective final control element is also introduced practically without loss directly into the governor and does not need to overcome any further initial stress or counteracting forces.

Advantageous further embodiments and improvements in the rpm governor are possible. Thus, in particularly advantageous fashion, an adjustment force can be generated which is independent of travel distance, when an electromagnet is used as the corrective final control element and has an adjustment force independent of the adjustment path and proportional solely relative to the energizing current of the control circuit. Thus, the armature of the electromagnet at least indirectly engages one of the elements of the governor which are moved in accordance with rpm during idling control. The invention extends, of course, also to variant embodiments in which the corrective final control element directly engages the supply quantity adjustment member of the injection pump.

Good and rapid response upon idling correction is attained and in an rpm governor known from the document cited above, having a guide lever supported on a rotary axis attached to the housing and guiding one end of the governor element, with appropriate reduction, very short adjustment paths are attained for the electromagnet. This also brings about a compact electromagnet which can be provided in simple fashion with an adjustment force independent of the adjustment path and proportional solely relative to the energizing current.

In an rpm governor, also known from the document cited above, having a force transmitting member subject to the restoring force of a main governor spring and arranged to contact a stop attached to the housing, the embodiment of the governor enables the installation of the idling correction apparatus on an already available governor without extensive conversion. By means of the deflection element, the adjustment path of the electromagnet needs to correspond only to the idling sleeve path of the governor member.

As a result, the control circuit can be adapted in simple fashion to the characteristics of the particular engine. As a result, a continuous closed-loop control of the idling rpm is possible, which enables a cyclical closed-loop control for maintaining a predetermined idling rpm. By means of the switches, a solely on-off switching is realizable both in the case of open-loop and closed-loop control, which results in an inexpensive circuit when relatively limited demands are placed on the quality of the open-loop or closed-loop control.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
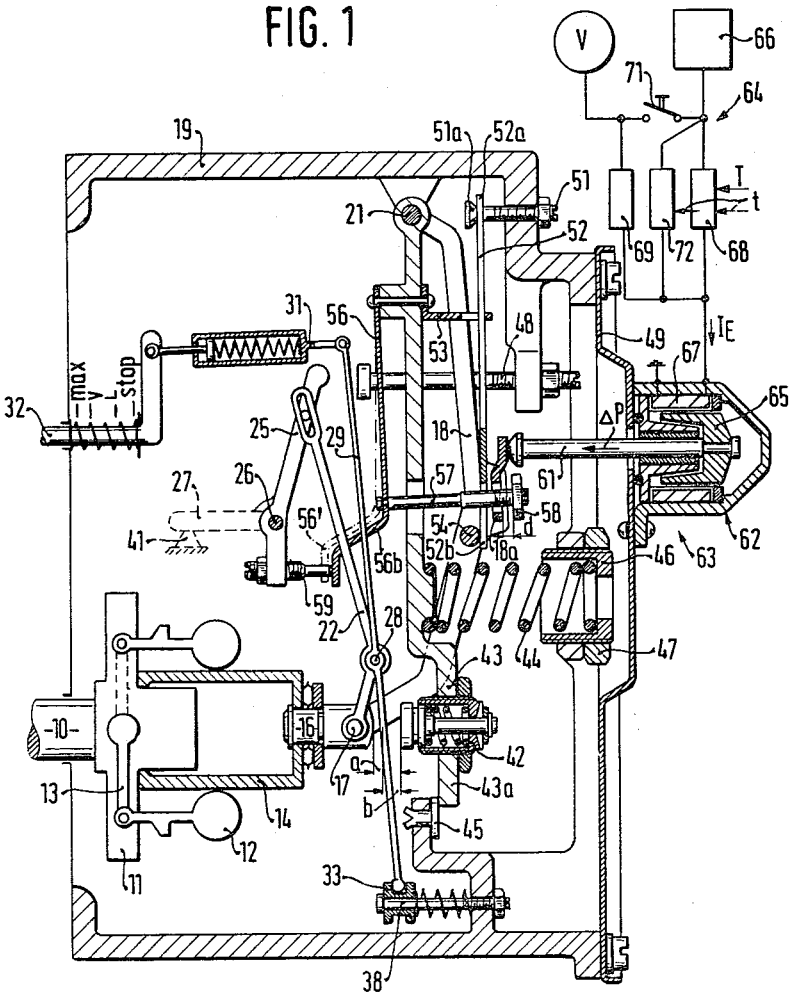
FIG. 1 is a simplified cross-sectional view through the first exemplary embodiment.

On the camshaft 10 of a known injection pump for internal combustion engines, which is not shown in further detail, a flyweight carrier 11 of a centrifugal rpm governor embodied as an idling and final rpm governor, on which carrier 11 flyweights 12 are supported in a pivotable manner. These flyweights 12, with pressure arms 13, engage a governor sleeve 14 which serves as the control member and is thus adapted to transmit the sleeve stroke effected by the flyweights 12 to a bolt 16. The bolt 16 is articulated by means of a bearing tang 17 that is disposed on a guide lever 18 and which is pivotable on a bearing pin 21 secured in the governor housing 19 and thus, acting as a rotary axis, guides the governor sleeve 14 in its stroke movements.

By means of the bearing tang 17, a shift lever 22 is also articulatedly connected with the sleeve bolt 16 and furthermore pivotably connected to a lever-like setting member 25. The setting member 25 is secured on a lever shaft 26 supported as a pivot axis in the governor housing 19 which can be actuated by a service lever 27 shown in broken lines that is located outside the governor housing 19. The shift lever 22 is connected via a bearing point 28 with an intermediate lever 29 which serves as a control lever. The control lever is articulated at one end via an elastically yielding tongue 31 onto a control rod 32 which serves as the supply quantity adjustment member of the injection pump and is pivotably supported on the other end on a slidable bearing member 33.

By means of a setting screw 38, the slidable bearing member of the intermediate lever 29 is fixed in the axial direction of the governor sleeve 14 and can be changed by means of twisting the setting screw 38 for the purpose of making the basic setting of the full-load position of the control rod 32 which determines the full-load supply quantity, when, as is often desired by the engine manufacturer, the illustrated starting position and full-load position of the service lever 27 and thus of the setting member 25 is fixed by means of a full-load stop 41 that is attached to the housing and is not variable.

When the governor sleeve 14 has covered an idling sleeve path distance designated by the letter "a", the pressure bolt 16 then contacts an adapter spring capsule 42 which here serves as the stroke stop. The adapter spring capsule 42 is screwed into a force transmitting lever 43, which is pivotable about the bearing pin 21 and with its free end 43*a* is pressed by a main control spring 44 against a stop 45 that is attached to the housing. The initial stressing force of the main control spring 44 which functions as the final rpm control spring is determined by the position in which it is installed and can be readily set by means of a support 46 which comprises a threaded plug that is screwed into the governor housing 19. The threaded plug 46 is secured by means of a lock nut 47 in its set position and is disposed, like the stroke stop 42 and the setting screw 38 of the pivotal bearing 33 as well as an idling stop 48 embodied as a stop screw, within the governor housing 19 and is, like them, only accessible when a sealed locking cover 49 is removed.

Only a setting screw 51 which is adapted for the correction of the idling rpm of the engine is located outside the housing portion closed off by the cover 49 and thus is also accessible in the case of the sealed governor when the cover is removed. This is particularly advantageous, and is necessary for the purpose of adapting the idling rpm to the varying internal friction of different engines. A head 51*a* of the setting screw 51 located inside the governor housing 19 acts as an adjustable support for an end 52*a* of an idling spring member 52 embodied as a leaf spring, which is supported on the force transmitting lever 43 via a support angle bracket 53 which serves as a fixed support bearing or seat and with its terminal end 52*b* remote from the support 51*a* presses against a transverse bolt 54 that is disposed on the guide lever 18.

On the force transmitting lever 43, at the level of the fastening of the support angle bracket 53, there is secured an idling spring member 56 which is embodied as a leaf spring, which is provided with a connecting bolt 57. The connecting bolt 57 bears an adjusting nut 58, the distance d of which form a coupler part 18*a* on the guide lever 18 determines the portion b of the idling sleeve path a which determines the effective range of the additional idling spring member 56. In the illustrated full-load position of the setting member 25, the additional idling spring member 56 is pressed by a pressure screw secured on the setting member 25 out of its idling position indicated at 56' into the illustrated position, in which, during the course of the idling sleeve path a covered by the governor member 14 during starting, it is ineffective.

Engaging the coupler element 18*a* firmly connected to the guide lever 18 is a pressure pin 61 of a corrective final control element 62 which is secured on the locking cover 49, of an idling correction apparatus 63. The corrective final control element 62 here comprises an electromagnet embodied as a proportional or linear magnet, which is structured in a known manner such that it produces an adjustment force $\Delta P$ independent of adjustment path and solely proportional to the governor current $I_E$ of an electrical control circuit 64. An armature 65 of the electromagnet 62 is firmly connected to the pressure pin 51 and transfers the adjustment force $\Delta P$ indicated by an arrow in the pressure pin 61 onto the guide lever 18, which in this embodiment according to FIG. 1 acts as a force transmitting element for transmitting this adjustment force into the governor member 14.

The control circuit 64, shown in greatly simplified form and containing only the most essential components, is provided with a source 66 of electrical current and controls, primarily in accordance with temperature, the energizing current $I_E$ indicated by an arrow of a coil 67 of the electromagnet 62. Disposed in the electrical circuit of the control circuit 64 is a control element 68 which functions in accordance with a temperature T acting as the engine parameter, in series with the coil 67, which is embodied as a cold conductor (PTC resistor). This temperature-dependent resistor 68 may also be designed such that it is additionally heated up by the current flowing through it and thus acts as a control element which functions in accordance with time as well, which is indicated by an arrow t drawn in broken lines.

If in addition, consumers V, such as air-conditioning systems, compressors or the like are additionally driven by the engine, then the idling output of the engine may under some circumstances change greatly, and this changed output is taken into consideration in the control circuit 64 by means of a preliminary resistor 69 which is adapted to compensate for this additional load on the engine. The preliminary resistor 69 is introduced into the control circuit 64 parallel to the control element 68 and is switched on by a switch 71 when the consumer V is switched on. Parallel to the resistors 68 and 69 is a time-dependent resistor 72, introduced as a further control element functioning in accordance with time, which controls a partial current of the energizing current $I_E$. This time-dependent resistor 72 may be omitted if a control effected only in accordance with temperature brings about a sufficiently precise maintenance of the idling rpm.

In place of the control element 68 which functions in accordance with temperature and arranged to control a continuously varying energizing current $I_E$, the control circuit 64 can also contain a switch functioning in accordance with temperature, which then permits only an on-off control of the energizing current. This is possible when limited demands are placed on the precision of the idling rpm to be maintained and is then relatively inexpensive.

Figure 2:
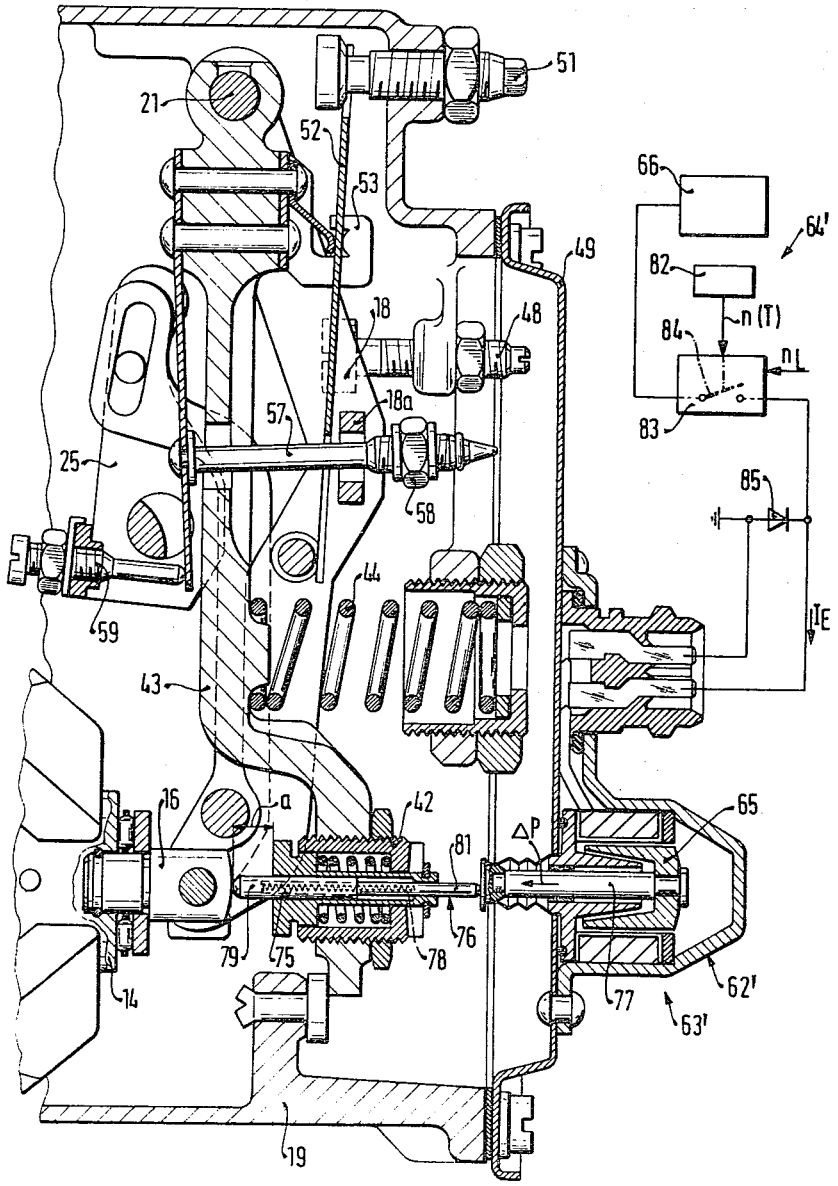
FIG. 2 is a fragmentary sectional view through a practical second embodiment.

FIG. 2 shows the essential elements of a practical second embodiment which is essential to the invention; the elements, shown in simplified form, and which correspond to and function like those of FIG. 1 are given the same reference numerals, while components which are slightly modified are given a prime.

The force transmitting lever 43 pivotable about the bearing pin 21 and acting as the force transmitting element for the main control spring 44 contains, in a central longitudinal bore 75 of its stroke stop 42 which is embodied as an adaptation capsule, a pressure pin 76, which as the transmitting element for the adjustment force ΔP of an electromagnet 62' acting as the corrective final control element of an idling correction apparatus 63' is disposed in the extension of the longitudinal axis of the governor sleeve 14 between the sleeve bolt 16 of the governor member 14 and a pressure bolt 77 connected to the armature 65 of the electromagnet 62'.

The pressure pin 76 comprises two casings 79 and 81 guided one within the other in telescope fashion and containing a deflection spring 78 and thus serves at the same time as the spring-like, yielding deflection element. Such a deflection element being disposed in the connection between the electromagnet 62' and the governor sleeve 14 has the advantage that the stroke of the armature 65 of the electromagnet 62' needs to be only as large as the idling sleeve path a of the governor sleeve 14. The governing stroke of the governor sleeve 14 subsequent to the idling sleeve path, and thus the corresponding path of the force transmitting lever 43 covered counter to the force of the main control spring 44, is then performed by the deflection element 76. The structural length of the entire governor is accordingly not unduly increased, and the adjustment force ΔP which is preferably independent of the adjustment path and fixed only by the energizing current $I_E$ of a control circuit 64' can be particularly favorably maintained for a relatively short stroke given a correspondingly simple embodiment of the components of the electromagnet 62'.

The control circuit 64' supplied by the electrical current source 66, in the exemplary embodiment shown in FIG. 2, serves to effect not open-loop but closed-loop control of the energizing current $I_E$, because here the actual rpm n detected by an rpm transducer 82 is fed, as the sole engine parameter, into a comparison circuit 83 of the control circuit 64' and after comparison with a desired rpm value $n_L$ it is converted to the energizing current $I_E$ which determines the adjustment force ΔP of the electromagnet 62'.

The electromagnet 62' can also be operated cyclically, and when there are limited demands for constancy in the idling rpm $n_L$ then instead of the comparison circuit 83 a switch 84, shown in dot-dash lines, which is actuated in accordance with rpm can be used. Here it is particularly advantageous if a preset energizing current $I_E$ is controlled by the current source 66 and the switch 84, upon exceeding an upper desired rpm value, opens the electrical circuit and when a lower desired rpm value is not attained closes this electrical circuit again. In order to cancel out any current surges which occur, a freewheeling diode 85 is introduced into the circuit.

The switch 84 can also be operated in accordance with the exceeding, or non-attainment, of a temperature threshold T, as indicated in brackets, instead of in accordance with an rpm-dependent signal. Then, however, only on-off control occurs and additional consumers would have to be switched in by means of the parallel disposition of a preliminary resistor which corresponds to the preliminary resistor 69 of FIG. 1.

The circuits given in FIGS. 1 and 2 are not restricted to these examples, but rather can be interchanged or used for triggering corrective final control elements which engage other points of the governor.

The mode of operation of the governor embodied in accordance with the invention and shown in FIGS. 1 and 2 will now be briefly described in order to supplement the foregoing specification.

All the governor elements in FIG. 1 are shown in the position of rest when the setting member 25 is pivoted into the full-load position for starting; in this position of rest, the service lever 27 is in contact with the full-load stop 41. The control rod 32 is in the maximum position which determines the starting quantity, this position being indicated in the drawing by "max". Upon starting of the engine, the flyweights 12 swing outward and the governor sleeve 14 performs its idling sleeve stroke a and thus draws the control rod 32, via the control lever 29, into its full-load position V. Now when, in order to govern the idling rpm, the setting member 25 is drawn back into its idling position (not shown), then the setting member pivots clockwise about the lever shaft 26 and contacts the idling stop 48. At this time, the additional idling spring member 56 is in its position marked in dot-dash lines at 56' which influences the idling control operation and when the idling rpm is maintained the control rod 32 assumes a position L. When the engine is cold, however, this normal position is not sufficient to supply the engine with the supply quantity which corresponds to idling output. Thus, if the operating temperature T is below a certain temperature threshold, then the control circuit 64 has supplied a corresponding energizing current $I_E$ to the coil 67 of the electromagnet 62, and the armature 65 exerts an additional adjustment force ΔP, increasing the idling supply quantity, on the guide lever 18 via the coupler part 18*a*. This guide lever 18 transmits this additional force onto the governor sleeve 14, which at the same idling rpm causes a correspondingly predetermined displacement of the control rod 32 from its normal idling position L toward the full-load position V. When the temperature of the engine is increasing or after the passage of a predetermined period of time, the cold conductor 68 and the time-dependent resistor 72 reduce the energizing current $I_E$ and the adjustment force ΔP drops accordingly, until it has been entirely eliminated. The control rod 32 is then again in its idling position L which is fixed for normal operation.

The same function is also performed in FIG. 2 by the electromagnet 62'; however, its adjustment force ΔP is directly transmitted onto the governor sleeve 14. However, as has already been described, if instead of an energizing current $I_E$ controlled in accordance with rpm an on-off switching is performed by the switch 84, then in accordance with the switching on or off of the energizing current $I_E$ an adjustment force ΔP predetermined by the electrical current source 66 is switched briefly on or off. As a result of this additional force, which varies abruptly, the engine shifts between a lower and an upper idling rpm. If this switching is embodied as sufficiently rapid and with narrow tolerances, then this causes a cyclical impact on the governor sleeve 14 and in practical terms brings about a constant position of the control rod adapted to the particular operational status of the engine prevailing at that time.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. An rpm governor for a fuel-injected internal combustion engine, in particular, a centrifugal rpm governor of an injection pump for a Diesel motor vehicle engine, having a housing, a governor member which adjusts in accordance with rpm, a supply quantity adjustment member, at least one intermediate lever wherein control movements of said governor member are transmissible via said at least one intermediate lever onto said supply quantity adjustment member of said injection pump, and an idling spring wherein said governor member operates within an idling sleeve path of travel against the force of said idling spring, said rpm governor having an idling correction apparatus including an electromagnet having a coil, an armature and a pressure pin which is firmly connected to said armature and in pressure contact with said idling spring which influences the idling operation and said electromagnet is triggered in accordance with at least one engine parameter by means of a control circuit characterized in that said governor member can be acted upon additionally by an adjustment force of said electromagnet, which said adjustment force is variable by means of an energizing current of said control circuit in accordance with at least said one engine parameter and is independent of an adjustment path within which said electromagnet operates in order to maintain the idling rpm.

2. An rpm governor in accordance with claim 1, further characterized wherein said armature engages said governor member by means of a transmitting element movable in accordance with rpm by said governor member.

3. An rpm governor in accordance with claim 2 which further includes a guide lever supported on a rotary axis attached to said housing and arranged to guide one end of said governor member, further characterized wherein said guide lever acts as said transmitting element.

4. An rpm governor in accordance with claim 3, characterized wherein said guide lever is further provided with a coupler part which is engaged by a pressure pin actuated by said armature of said electromagnet.

5. An rpm governor in accordance with claim 4, characterized wherein said pressure pin further comprises a telescopable casing containing a deflection spring means.

6. An rpm governor in accordance with claim 2, further including a force transmitting member subject to the restoring force of a main control spring and arranged to contact a stop attached to the housing further characterized wherein said force transmitting element further includes a pressure pin.

7. An rpm governor in accordance with claim 6, characterized wherein said pressure pin is slidably guided in a bore of a stroke stop means therein.

8. An rpm governor in accordance with claim 7, further characterized wherein said electromagnet and said pressure pin have axes coincident with said governor member.

9. An rpm governor in accordance with claim 2, further characterized wherein said armature engages said governor via a yieldable deflection member provided with a deflection spring means.

10. An rpm governor in accordance with claim 1, characterized wherein said control circuit further contains at least one control member which functions in accordance with time.

11. An rpm governor in accordance with claim 1, characterized wherein said control circuit further includes a control element having a switch means disposed in series with said coil of said electromagnet and said control circuits further arranged to function in accordance with temperature.

12. An rpm governor in accordance with claim 11, wherein said temperature-dependent control element further includes at least one preliminary resistor, said resistor being adapted to an additional load on said engine and capable of being switched in parallel with a temperature-dependent control element.

13. An rpm governor in accordance with claim 1, further characterized wherein said control circuit is fed an engine parameter by an rpm transducer and after comparison with a desired rpm value is converted into an energizing current which determines the adjustment force of said corrective final control element.

14. An rpm governor in accordance with claim 1, characterized wherein said control circuit further includes a control element having a switch disposed in series with said coil of said electromagnet and said control circuit is further arranged to function in accordance with one engine parameter.

* * * * *